US007669937B2

(12) United States Patent
Fecteau et al.

(10) Patent No.: US 7,669,937 B2
(45) **Date of Patent: *Mar. 2, 2010**

(54) CONTINUOUS EXTRACTION OF UNDERGROUND NARROW-VEIN METAL-BEARING DEPOSITS BY THERMAL ROCK FRAGMENTATION

(75) Inventors: Jean-Marie Fecteau, Rouyn-Noranda (CA); Sylvie Poirier, Val-d'Or (CA); Marcel Laflamme, Val-d'Or (CA); Gill Champoux, Laval (CA)

(73) Assignees: Hydro-Quebec, Montreal (CA); Her Majesty the Queen in right of Canada, as represented by the Minister of Natural Resources, Ottawa (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/126,963

(22) Filed: May 26, 2008

(65) Prior Publication Data

US 2008/0224527 A1 Sep. 18, 2008

Related U.S. Application Data

(63) Continuation of application No. 10/836,616, filed on May 3, 2004, now Pat. No. 7,377,593.

(51) Int. Cl.
*E21C 37/16* (2006.01)
*E21C 37/00* (2006.01)

(52) U.S. Cl. ..... 299/14; 299/19; 175/11; 175/16

(58) Field of Classification Search ..... 299/14, 299/19; 175/11, 16
See application file for complete search history.

(56) References Cited

U.S. PATENT DOCUMENTS

| | | | | | |
|---|---|---|---|---|---|
| 2,481,051 | A | * | 9/1949 | Uren | 299/2 |
| 3,161,900 | A | * | 12/1964 | Hanns et al. | 15/345 |
| 3,207,238 | A | * | 9/1965 | Davidson et al. | 175/14 |
| 3,211,242 | A | * | 10/1965 | Browning | 175/14 |
| 3,245,721 | A | * | 4/1966 | Margiloff | 299/14 |
| 3,322,213 | A | * | 5/1967 | Arnold et al. | 175/14 |
| 3,362,752 | A | * | 1/1968 | Densmore | 299/18 |
| 3,481,648 | A | * | 12/1969 | Kohler | 299/14 |
| 3,704,914 | A | * | 12/1972 | Fletcher, Jr. | 299/14 |
| 3,718,367 | A | * | 2/1973 | Schumacher | 299/14 |
| 3,759,575 | A | * | 9/1973 | Boyd et al. | 299/32 |
| 3,788,703 | A | * | 1/1974 | Thorpe | 299/14 |
| 3,917,348 | A | * | 11/1975 | Janssen | 299/13 |
| 4,319,647 | A | * | 3/1982 | Browning | 175/14 |
| 4,653,697 | A | * | 3/1987 | Codina | 241/1 |

(Continued)

*Primary Examiner*—Shane Bomar
(74) *Attorney, Agent, or Firm*—Jones, Tullar & Cooper, P.C.

(57) ABSTRACT

A method for extracting minerals from a narrow-vein deposit by thermal fragmentation is provided. The method includes locating the vein and determining the extent thereof to form the boundaries of a stope. Access to the stope is prepared by forming a panel having an upper drift and a lower drift. Equipment for thermal fragmentation, including a burner, is installed from the upper drift. The burner moves along the panel surface in a sweeping motion, while rock chips spalled from the rock panel surface are collected. Multiple panels for processing can be realised, with lower panels being processed before upper panels, by excavating a sub-level to separate the lower and upper panels.

10 Claims, 3 Drawing Sheets

U.S. PATENT DOCUMENTS

| | | | | |
|---|---|---|---|---|
| 4,741,405 | A * | 5/1988 | Moeny et al. | 175/16 |
| 5,007,683 | A * | 4/1991 | Granskog | 299/10 |
| 5,033,795 | A * | 7/1991 | Farrar et al. | 299/18 |
| 5,896,938 | A * | 4/1999 | Moeny et al. | 175/1 |
| 6,215,734 | B1 * | 4/2001 | Moeny et al. | 367/147 |
| 6,857,706 | B2 * | 2/2005 | Hames et al. | 299/18 |
| 6,913,320 | B2 * | 7/2005 | Brisebois | 299/14 |
| 7,195,320 | B2 | 3/2007 | Brisebois | |
| 2003/0173819 | A1 * | 9/2003 | Hames et al. | 299/19 |
| 2006/0037779 | A1 * | 2/2006 | Moeny et al. | 175/16 |

* cited by examiner

CONTINUOUS EXTRACTION OF UNDERGROUND NARROW-VEIN METAL-BEARING DEPOSITS BY THERMAL ROCK FRAGMENTATION

CROSS REFERENCE TO RELATED APPLICATIONS

This application is a continuation under 35 U.S.C. 120 of U.S. application Ser. No. 10/836,616, filed May 3, 2004, which is scheduled to issue as U.S. Pat. No. 7,377,593 on May 27, 2008.

FIELD OF THE INVENTION

The present invention relates to a method for extracting minerals from a narrow-vein mining deposit through utilization of a thermal-induced rock fragmentation to channel out the mineralization.

BACKGROUND OF THE INVENTION

Exploitation of narrow-vein deposits represents great challenges. Highly selective mining methods for this type of exploitation are associated with high operational constraints that interfere with mechanization. Conventional methods require a substantial amount of skilled manpower, which is becoming a scarce commodity. High operational costs results in the profitability of these deposits to be rather risky. In order to ensure the survival of this type of exploitation, it is crucial to develop innovative equipment and mining methods.

The mineral inventory of a mining operation is classified into reserves and resources, reserves being the economically mineable part. Resources involve a level of geological knowledge that is usually insufficient to enable an appropriate economic evaluation or, in some cases, the estimated grade is lower than the economic grade.

In recent years, the long-hole mining method has been used in some narrow-vein ore mining operations. Such a method is not always suitable to the operation conditions. Implementation of the method involves large blasts that damage the rock mass with several fractures that cause rock face instability resulting in frequent fall of waste rock. This waste mixes up with the broken ore and adds to the planned dilution in reserve estimate. Like the ore, this waste rock must be mucked and processed, significantly increasing operation costs.

SUMMARY OF THE INVENTION

One aspect of the present invention relates to a method for extracting minerals from a narrow-vein deposit. Location of the vein and determination of the extent thereof forms the boundaries of the stope. Access to the stope is prepared by excavating an upper drift and a lower drift to form a panel therebetween. Equipment and a burner are installed from the upper drift. The burner is moved along a panel surface in a predetermined pattern, while spalled rock chips from the panel surface are collected at the lower drift. By providing highly selective extraction of ore, thermal fragmentation allows for substantial savings on ore transportation, ore processing and on the environmental level by reducing the generated waste volume.

Another aspect of the invention relates to a method of extracting minerals from narrow-vein deposit including the step of ascertaining the extent of the vein and establishing an extraction zone of material, which extends beyond the extent of the vein. A surface of the extraction zone is then exposed after which a source of heat is provided, capable of inducing thermal fragmentation of the material in the extraction zone. The source of heat is moved across the surface while maintaining sufficient proximity to cause thermal fragmentation of the material on the surface. The fragmented material is collected.

Another aspect of this invention includes the use of a plasma torch for extraction of narrow-vein mineral deposits. The plasma torch is moved across a surface of the deposit, in a sweeping movement, at a rate which, while maintaining sufficient proximity of the plasma torch with the surface of the deposit, induces thermal fragmentation to a layer of the deposit.

BRIEF DESCRIPTION OF THE DRAWINGS

The following description will be more readily understood with reference to the drawings in which a preferred embodiment of the invention is illustrated.

DESCRIPTION OF THE PREFERRED EMBODIMENTS

A mining method generally consists of four distinct steps: drilling, blasting, mucking, and transport of the ore to the shaft for hoisting to the surface. The application of the method described herein enables a reduction in the required number of steps; drilling and blasting being replaced by a single step of continuous rock fragmentation.

The present invention provides a method of using a burner to exploit underground narrow-vein metalliferous deposits by thermal fragmentation, through sweeping in a sequence across the height and width of the vein. Most of the items or equipment required to perform the method are in common usage in mining operations, except for the plasma torch equipment and a vacuum system to draw off the ore. A plasma torch is used as the source of heat by which thermal fragmentation or spalling of a surface layer of the deposit is induced. While other types of burners could be utilized, plasma torches are preferred as they do not produce the emissions that combustible fuel torches do. Plasma torches produce intense heat and the higher rate of heating expedites the thermal fragmentation process. The intense heat, however, necessitates the movement of the torch in a sweeping pattern to avoid localized fusion of the rock.

Figure 1A:
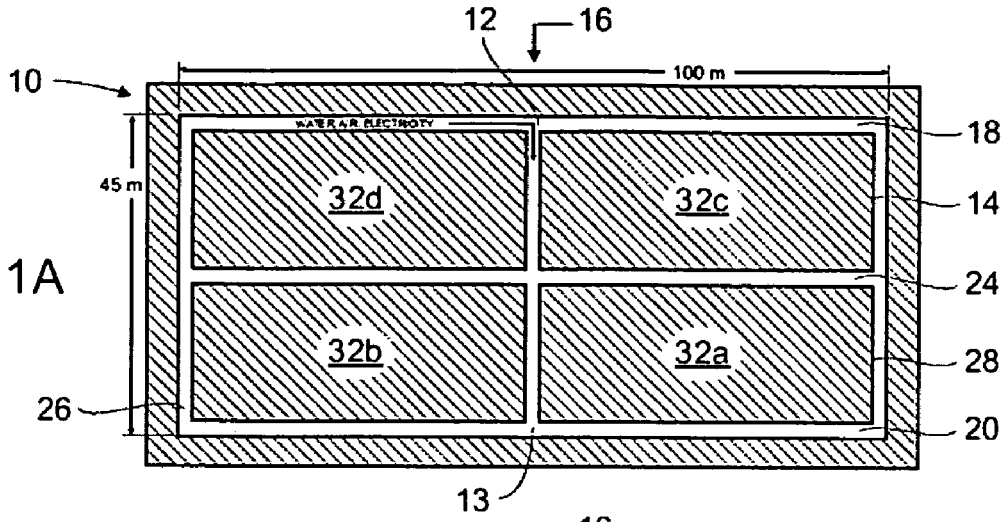
FIG. 1A is an elevational view of a cross-section of a stope, with FIG. 1B being a plan view thereof, showing a first phase of the operation.
Figure 1B:
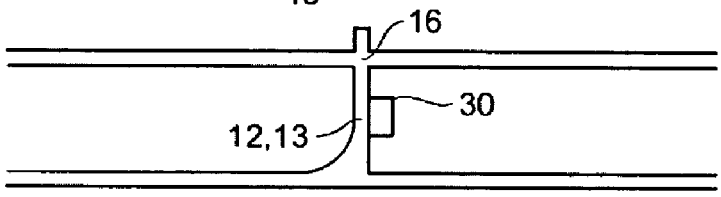

FIGS. 1A and 1B illustrate the general arrangement of a standard stope 10. In a first phase, cross-cuts 12,13 are developed to access the upper and lower levels of a mineralized block 14. These accesses 12,13 are planned to intercept mineralization at the block centre 16, thus separating the stope 10 in two. From the upper and lower accesses 12,13, upper and lower drifts 18,20 are developed in the ore. The plan view of FIG. 1B shows the stope accesses 12,13 leading to the drifts 18,20. These drifts 18,20 represent the upper and lower limits of the stope 10 to be processed. Preferably, the maximum distance on either side of the stope access is limited to 50 meters, which will ensure proper efficiency of the vacuum devices and plasma torch. One skilled in the art would appreciate the distance may vary according to the limitations of different equipment.

After the stope accesses 12,13 and drifts 18,20 are completed, a service raise 22 is excavated at the block centre 16. The main purpose of the raise 22 is to enable workers to access sub-levels, transport equipment and to supply required ventilation, water, air and electric lines.

From the service raise 22, a sub-level 24 is preferably excavated to reduce the vertical mining distance in order to easily follow the mineralization, which is generally not rectilinear over long distances. Slot raises 26,28 are also developed at each stope extremity to allow initial installation of the plasma torch equipment (not shown in FIGS. 1A and 1B). Finally, small openings 30 are preferably excavated in the upper and lower stope cross-cuts accesses for the installation of the vacuum device and the equipment required to operate the plasma torch. The final arrangement of the various drifts and raises results in the mineral block 14 being sectioned into a plurality of panels 32.

Preliminary tests that were performed on granite blocks demonstrated that rock is broken into small chips or fragments by moving a plasma torch along the rock surface. This rock-fracturing through thermal fragmentation occurs as a result of thermal shock created by the plasma torch flame on contact with the rock surface. The generated chips have a dimension that is usually less than 2 cm.

Figure 2A:
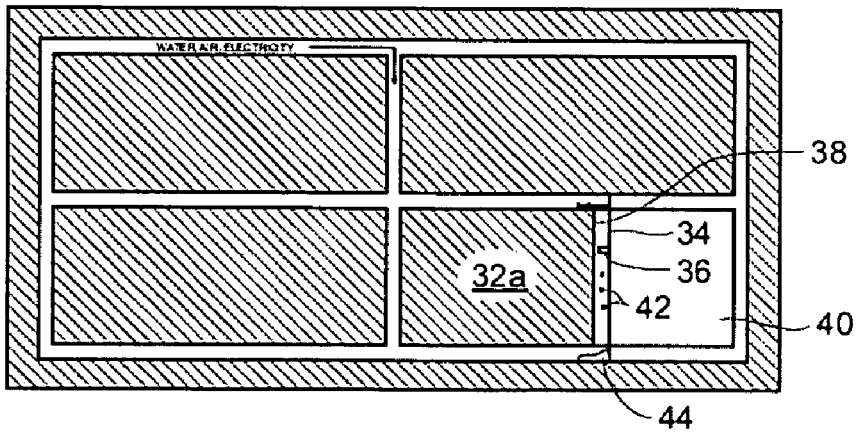
FIG. 2A is an elevational of a cross-section of a stope, with FIG. 2B being a plan view thereof, showing a second phase of the operation.
Figure 2B:
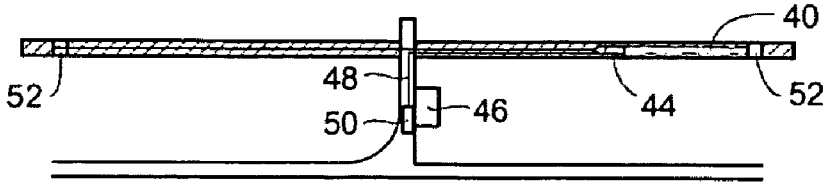

As shown in FIGS. 2A and 2B, burner equipment 34 is installed from the sub-level 24 or from the drift located above the section to be extracted. During fragmentation, the burner 36 is moved from top to bottom in a back-and-forth movement, as well as from left to right between the sidewalls of the panel. When the spalling efficiency diminishes, a mechanism associated with the equipment 34 brings the burner 36 closer to the rock face 38. Once the mechanism reaches a maximum extension, all of the equipment 34 is brought closer to the face 38 and spalling continues. Preferably the burner 36 is moved at a controlled rate through a predetermined pattern.

Figure 3A:
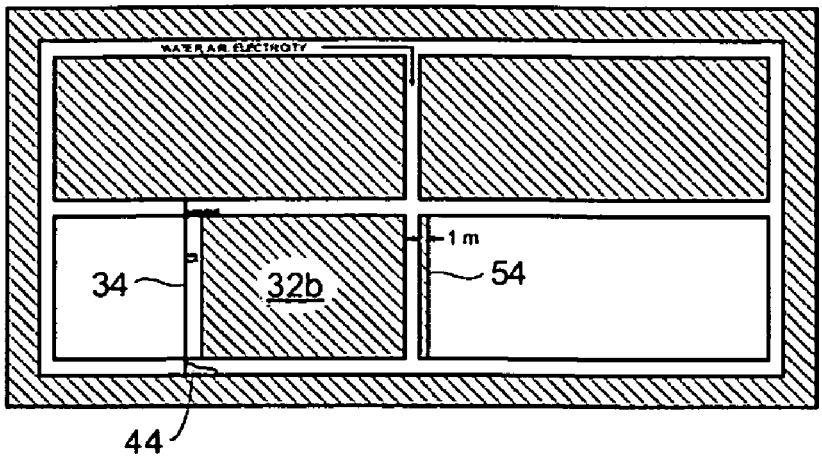
FIG. 3A is an elevational of a cross-section of a stope, with FIG. 3B being a plan view thereof, showing a third phase of the operation.
Figure 3B:
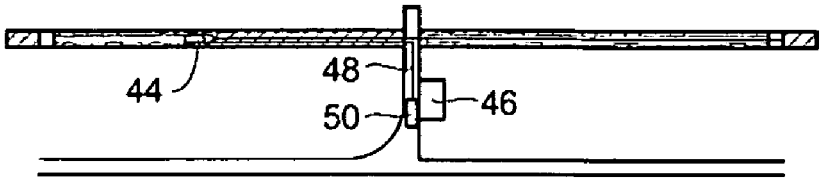

As indicated above, the preferred embodiment of the stope 10 is separated into four panels 32 and each panel 32 is extracted consecutively in a predetermined sequence. After the extraction of a panel 32 as shown in FIG. 3A, an opening is created between two drifts or, in the case of FIG. 3A, between the lower drift 20 and the sub-level 24; consequently, it will be impossible to travel in the lower drift. Thus, extraction should begin in the lower panels 32*a*, 32*b* and then move upward.

As the burner 36 sweeps along the rock face 38, the rock chips 42 are extracted. Since this mining method is directed towards a highly selective ore extraction, the excavated rock volume is low while the grade of the rock is high. The low rock volume produced to be handled enables a simple mucking system to be implemented at a low cost. An example of such a system is shown in FIGS. 2A and 2B which uses a metal container 44 that can hold up to 8 tons of ore. The container 44 is positioned directly under the work face 38 at the base of the opening 40 to recover the falling rock fragments 42. The winch 52 hoists the container to follow the mining process. Afterwards, the accumulated ore is vacuumed by the vacuum system 46 through vacuum hoses 48 into a mine car 50. It is suggestible to perform mucking twice per work shift, thereby eliminating the requirement of having a full-time employee on mucking operations.

The mining sequence of the preferred stope embodiment is shown in FIGS. 2A to 5A. Firstly, the plasma torch equipment 34 is installed in the sub-level 24 above panel 32*a*, as shown in FIG. 2A. The ore container 44 and the winch 52 are installed in the lower drift. The vacuum system 46 is located in the lower stope access 13 and a hose 48 of sufficient length is used to vacuum the accumulated ore from inside the container 44. The burner 34 is moved across the rock surface 38 in a repetitive sweeping movement to remove successive layers of rock 38, while the container 44 is moved in unison with the burner equipment 34 to continuously catch the falling rock fragments 42. Preferably, not the entire panel 32*a* is removed so as to leave a supporting pillar 54 (see FIG. 3B). Once panel 32*a* is complete, the equipment 34 is transferred to the opposite lower panel 32*b* for use in a similar arrangement, as shown in FIG. 3B.

Figure 4A:
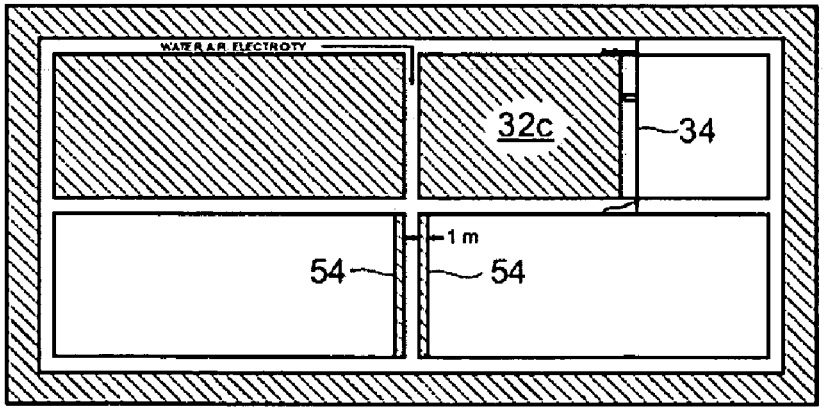
FIG. 4A is an elevational view of a cross-section of a stope, with FIG. 4B being a plan view thereof, showing a fourth phase of the operation.
Figure 4B:
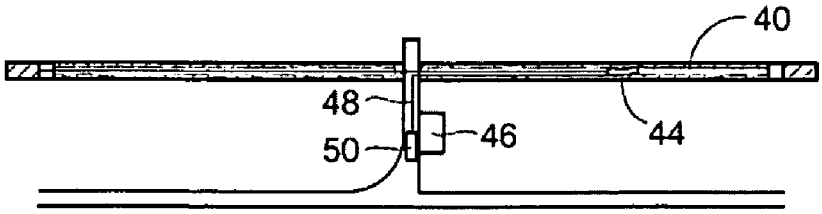
Figure 5A:
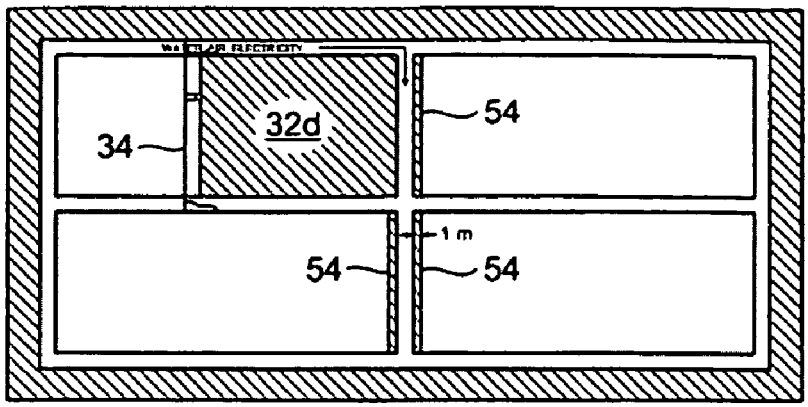
FIG. 5A is an elevational view of a cross-section of a stope, with FIG. 5B being a plan view thereof, showing a fifth phase of the operation.
Figure 5B:
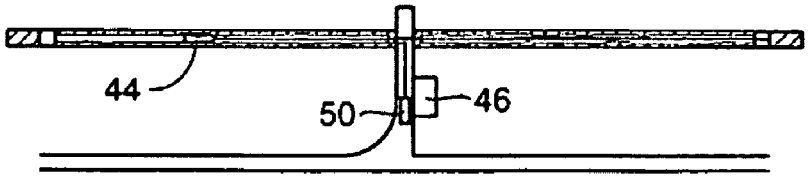
Figure 6A:
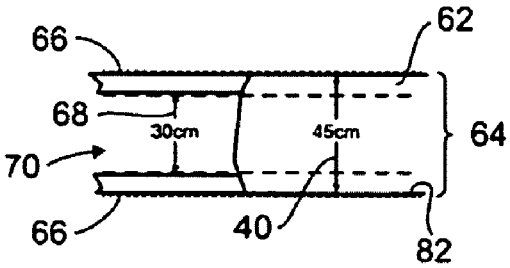
FIGS. 6A and 6B are schematic diagrams in plan view comparing thermal torch fragmentation method versus the prior art long-hole mining method.

In order to extract upper panels 32*c*, 32*d*, the plasma torch equipment 34 is mobilized in the upper drift 18 and the mucking equipment is installed in the sub-level 24, as shown in FIGS. 4A and 5A. However, the opening 40 created during the extraction phases, as shown in FIGS. 2A and 3A, extends through the sub-level floor an approximate width of 45 cm, as shown in FIG. 6A. Therefore, workers should be secured during their displacement, such as by securely tying themselves to a lifeline. Furthermore, depending on ground conditions, construction of a floor could be required to block access to the opening.

The vacuum system 46 remains in the lower access 13 throughout the extraction of the stope 10 and the suction hose 48 is extended as required. As mentioned previously, the service raise 22 or slot raises 26,28 are used to move equipment inside the stope 10.

Figure 6B:
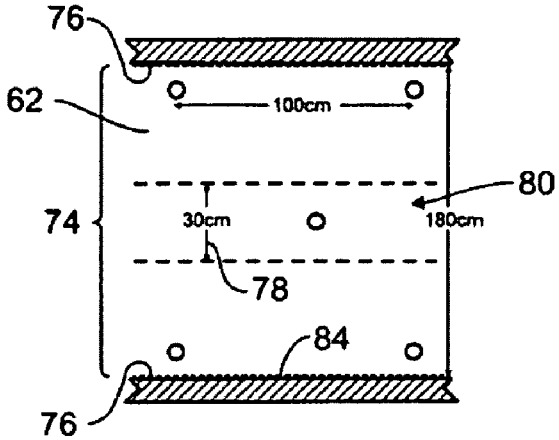
Fig. 6B Prior Art

The application of the thermal fragmentation method with a burner or plasma torch allows for high selectivity, the possibility of mechanization, continuous mining, immediate ore recovery, and elimination of the use of explosives. FIG. 6A shows that the opening 40 formed with the present thermal fragmentation method is 4 times smaller than the opening 60 formed through traditional long-hole mining with explosives as seen in FIG. 6B, therefore much less waste 62 is generated. The boundaries of the extraction zone 64 for the thermal fragmentation method, shown by dotted lines 66 in FIG. 6A, which extend beyond the ascertained width 68 of the vein 70, can be much narrower than the required extraction zone 74 for the long hole blasting method, shown by dotted lines 76 in FIG. 6B, which extend significantly beyond the ascertained width 78 of the vein 80, thus leading to greater amount of waste 62 in the mined ore.

Furthermore, after the extraction, the walls 82 have more stability than walls 84 that have been massively fractured, as through long-hole blasting methods. Mineral recovery is immediate, as compared to conventional methods in which the mineral may remain underground in inventory for a period of time, sometimes being non-recoverable due to stope instability, which results in significant financial loss.

As shown in Table 1, selective mining allows for a substantial reduction in extracted tonnage. A smaller volume of rocks for handling and processing directly impacts operation costs. Moreover, a continuous penetration in the rock allows dynamic readjustment of the extraction in order to stay inside the mineralized zone and consequently avoid dilution from mining.

The method of the present invention allows for continuous extraction since the process do not generate large amount of gas compared with the explosives. A 7-day work schedule is therefore possible, rather than the typical 5-day work schedule currently employed in narrow-vein mines. Such a work schedule would increase annual production, thereby decreasing indirect operational and depreciation costs.

TABLE 1

Comparison of thermal fragmentation with plasma torch and long-hole mining methods

| Calculated Tonnage base on a reserve block of 100 m by 45 m | Thermal Fragmentation | Long-hole |
|---|---|---|
| Grade in situ (oz/s. ton) | 1.70 | 1.70 |
| Width in situ (cm) | 30 | 30 |
| Ore development | | |
| Development tonnage (s. ton) | 6 506 | 8 130 |
| Development grade (oz/s. ton) | 0.22 | 0.22 |
| Mining | | |
| Geological reserves (s. ton) | 3 166 | 2 965 |
| Grade of geological | 1.70 | 1.70 |
| reserves (g/t) | 45 | 180 |
| Minimum width (cm) | 50% | 500% |
| Planned dilution | 0% | 35% |
| Walls dilution | 95% | 85% |
| Stope recovery | 4 511 | 20 413 |
| Planned mining reserves (s. ton) | 1.13 | 0.21 |
| Mined grade | | |
| Mill recovery | 95% | 95% |
| Produced ounces (stope and development) | 6 220 | 5 757 |

| | Thermal fragmentation | | Long-hole | |
|---|---|---|---|---|
| | Unit cost $/s. ton | Total $ | Unit cost $/s. ton | Total $ |
| Development | | 354 252 | | 462 889 |
| Mining cost ($/t) | 58.20 | 262 564 | 19.00 | 387 852 |
| Mucking | 5.00 | 22 557 | 4.00 | 81 653 |
| Transport to mill (stope) | 5.50 | 24 813 | 5.50 | 112 273 |
| Transport to mill (development) | 5.50 | 35 785 | 5.50 | 44 714 |
| Milling (stope) | 10.37 | 46 783 | 12.20 | 249 042 |
| Milling (development) | 12.20 | 79 377 | 12.20 | 99 183 |
| TOTAL | | 826 131 | | 1 437 607 |
| CAN$ per short ton | | 74.98 | | 50.37 |
| CAN$ per ounce | | 132.82 | | 249.71 |
| US$ per ounce | 0.65 | 86.34 | | 162.31 |

Experimental Setup

A test case was conducted by elaborating a mining concept using thermal rock fragmentation with a plasma torch to mine extremely narrow veins. The test case was developed according to commonly found stope dimensions in mining operations. A stope height of 45 meters was selected, which corresponds to the standard distance between two levels. For equipment operational reasons, the maximum length was fixed to 100 meters. Table 2 lists the details of development of the stope.

TABLE 2

Details of developments

| | Width (m) | Height (m) | Length (m) |
|---|---|---|---|
| Upper access | 2.7 | 2.7 | 10 |
| Lower access | 2.7 | 2.7 | 10 |
| Upper ore drift | 2.4 | 2.4 | 100 |
| Lower ore drift | 2.4 | 2.4 | 100 |
| Service raise | 2.4 | 2.4 | 40 |
| Sub-level | 2.4 | 2.4 | 98 |
| Slot raises | 1.8 | 1.8 | 76 |
| Excavation for plasma torch equipment | 3.0 | 2.4 | 4.5 |
| Excavation for vacuum | 3.0 | 2.7 | 4.5 |

One skilled in the art will appreciate that variations in the number of panels is possible. As an example, excavation could be performed in a single lower panel 1 or 2 without forming or expanding to the upper panels 3 or 4.

Another variation exists in the sweeping of the burner. The burner can be swept from left to right or right to left, while progressing from the top of the stope panel to the bottom. Alternatively, sweeping can occur from top to bottom, while progressing from left to right or right to left. The pattern and rate of motion of the burner/plasma torch will be dependent on several factors, including but not limited to the physical dimensions of the deposit, the composition of the deposit, variations in the deposit, desired fragmentation rate/volume, type and output of the burner/plasma torch, etc. The rate and pattern can be predetermined through theoretical considerations and/or empirical evaluation of test samples. The rate and pattern can also be adapted dynamically during the process to ensure optimization of fragmentation. Optimization does not necessarily mean increased fragment size, as fragment size can have an affect on the removal process in the case of vacuum removal, for example, or on subsequent processing steps. Volumetric removal rate (yield) is typically a better indicator of efficiency.

Another embodiment of the present invention provides for automatic operation of the equipment. Thus, the operator can safely remain in a workplace outside of the stope, while the automatic equipment operates within the stope. Cameras can be used to monitor progress. Furthermore, automatic detection of surface edges could be employed, further reducing input required from an external operator and eliminating the need for cameras. In such an automatic system, the burner could be provided on a platform extending up from the floor of the lower drift.

While there has been shown and described herein a method for continuous extraction of deposits in narrow-vein mining applications, it will be appreciated that various modifications and or substitutions may be made thereto without departing from the spirit and scope of the invention.

We claim:

1. A method of extracting minerals from a narrow-vein deposit comprising the steps of:

ascertaining the extent of the vein and establishing an extraction zone of material which extends beyond the extent of the vein;

exposing a surface of the extraction zone;

providing a source of heat capable of inducing thermal fragmentation of the material in the extraction zone;

moving the source of heat across the surface while maintaining sufficient proximity thereto so that heat from the source of heat is applied directly to the surface of the material so as to cause thermal fragmentation of the material on the surface, the source of heat being moved at a rate which is sufficient so as to: 1) substantially avoid localized fusion of the material on the surface and 2) break the surface of the deposit into fragments of a size of about 2 cm or less; and collecting the fragmented material.

2. The method according to claim 1 wherein the movement of the source of heat is in a repetitive sweeping pattern so as to remove layers of the material sequentially from the extraction zone.

3. The method according to claim 1 wherein the source of heat is a plasma torch.

4. The method according to claim 1 wherein the step of collecting is performed simultaneously with the thermal fragmentation step.

5. A method for using a plasma torch for extraction of a narrow-vein mineral deposit, comprising:

moving the plasma torch across a surface of the deposit at a rate while maintaining sufficient proximity of the plasma torch with the surface of the deposit, so that heat from the plasma torch is applied directly on the surface so as to induce by way of thermal shock thermal fragmentation of a surface layer of the deposit, said rate also being sufficient so as to break the surface of the deposit into fragments of a size of about 2 cm or less.

6. The method of claim 5 wherein the plasma torch is moved in a semi-repetitive pattern to remove successive layers of the deposit.

7. The method for using a plasma torch as claimed in claim 5, wherein said rate is sufficient so as to substantially avoid localized fusion of material on the surface of the deposit from the heat of the plasma torch.

8. A method for using a single plasma torch for extraction of a narrow-vein mineral deposit, comprising:

moving the plasma torch across an exposed surface of the deposit at a rate while maintaining sufficient proximity of the plasma torch with the surface of the deposit, so that heat produced by the plasma torch is applied directly to the surface of the deposit so as to induce by way of thermal shock thermal fragmentation of a surface layer of the deposit, said rate also being sufficient so as to break the surface of the deposit into fragments of a size of about 2 cm or less.

9. The method of claim 8 wherein the plasma torch is moved in a semi-repetitive pattern to remove successive layers of the deposit.

10. The method of claim 8, wherein said rate is sufficient so as to substantially avoid localized fusion of material on the surface of the deposit from the heat of the plasma torch.

* * * * *